US010472858B2

(12) United States Patent
Rocchitelli

(10) Patent No.: US 10,472,858 B2
(45) Date of Patent: Nov. 12, 2019

(54) CONTROL CIRCUIT FOR ACTUATING A LOCKING DEVICE FOR HOUSEHOLD APPLIANCES AND DEVICE COMPRISING SAID CIRCUIT

(71) Applicant: ELETTROTECNICA ROLD S.R.L., Nerviano (IT)

(72) Inventor: Stefano Rocchitelli, Pogliano Milanese (IT)

(73) Assignee: ELETTROTECNICA ROLD S.R.L., Nerviano (IT)

( * ) Notice: Subject to any disclaimer, the term of this patent is extended or adjusted under 35 U.S.C. 154(b) by 320 days.

(21) Appl. No.: 15/301,830

(22) PCT Filed: Mar. 31, 2015

(86) PCT No.: PCT/EP2015/056972
§ 371 (c)(1),
(2) Date: Oct. 4, 2016

(87) PCT Pub. No.: WO2015/155055
PCT Pub. Date: Oct. 15, 2015

(65) Prior Publication Data

US 2017/0058566 A1 Mar. 2, 2017

(30) Foreign Application Priority Data

Apr. 7, 2014 (IT) ..... MI2014A0631

(51) Int. Cl.
*E05B 47/00* (2006.01)
*H01F 7/06* (2006.01)
(Continued)

(52) U.S. Cl.
CPC ..... *E05B 47/0002* (2013.01); *A47L 15/4259* (2013.01); *H01F 7/064* (2013.01);
(Continued)

(58) Field of Classification Search
CPC ..... A47L 15/0081; A47L 15/4259; A47L 2501/22; D06F 2058/2858; D06F 37/28;
(Continued)

(56) References Cited

U.S. PATENT DOCUMENTS

2004/0083014 A1* 4/2004 Stubbs ..... E05B 17/22 700/78
2007/0108777 A1* 5/2007 Mueller ..... D06F 37/42 292/251.5
(Continued)

FOREIGN PATENT DOCUMENTS

FR 1483755 A * 6/1967 ..... A47L 15/4259

*Primary Examiner* — Thienvu V Tran
*Assistant Examiner* — Nicolas Bellido
(74) *Attorney, Agent, or Firm* — Abelman, Frayne & Schwab; Alexander Zinchuk; Steven M. Hertzberg

(57) ABSTRACT

The present invention relates to a locking device of a household appliance door comprising a circuit having a first, a second and a third connecting contacts to the household appliance, the device comprising a door locking switch, a door closing switch and an actuator arranged electrically in series with said door closing switch, at least one diode and at least one control switch on said third contact and electrically in series with said actuator. By virtue of this configuration, the locking and the unlocking of the door may be controlled by specific, different predetermined electrical pulses.

5 Claims, 3 Drawing Sheets

(51) Int. Cl.
*A47L 15/42* (2006.01)
*H01H 9/22* (2006.01)
*D06F 37/42* (2006.01)

(52) U.S. Cl.
CPC ..... *H01H 9/22* (2013.01); *D06F 37/42* (2013.01); *E05B 2047/0048* (2013.01); *E05B 2047/0068* (2013.01); *E05B 2047/0079* (2013.01)

(58) Field of Classification Search
CPC ..... D06F 37/42; D06F 39/14; D06F 58/04; D06F 58/28; E05B 2047/0048; E05B 2047/0068; E05B 2047/0079; E05B 47/00; E05B 47/0001; E05B 47/0002; E05B 47/0009; E05B 51/005; E05B 65/104; E05C 1/02; E05C 1/004; E05C 1/08; E05C 19/00; F16P 3/08; F23N 2041/08; H01F 7/064; H01H 9/22; H01H 9/226; H01H 2009/543; H01H 2231/012; H01H 2300/024; H01H 3/163; H01H 51/06; Y10S 292/65; Y10S 292/69; Y10S 70/10; Y10T 29/49169; Y10T 292/0887; Y10T 292/1014; Y10T 292/1021; Y10T 292/1082; Y10T 292/1092; Y10T 292/11; Y10T 292/699; Y10T 292/097
See application file for complete search history.

(56) References Cited

U.S. PATENT DOCUMENTS

2008/0106105 A1* 5/2008 Spiessl ..... A47L 15/4259 292/210
2011/0133490 A1* 6/2011 Berginc ..... A47L 15/4259 292/144
2012/0175894 A1* 7/2012 Hapke ..... D06F 39/14 292/144
2015/0361690 A1* 12/2015 Hintz ..... A47L 15/4259 292/138
2017/0004933 A1* 1/2017 Rocchitelli ..... H01H 3/163
2017/0011866 A1* 1/2017 Rocchitelli ..... D06F 39/14
2019/0172670 A1* 6/2019 Loong ..... H01H 47/002

* cited by examiner

CONTROL CIRCUIT FOR ACTUATING A LOCKING DEVICE FOR HOUSEHOLD APPLIANCES AND DEVICE COMPRISING SAID CIRCUIT

RELATED APPLICATION

This application is a National Stage application of International Application PCT/EP2015/056972 filed Mar. 31, 2015 and claiming priority of Italian Application MI 2014 A000631 filed Apr. 7, 2014, both applications are incorporated herein by reference thereto

FIELD OF THE INVENTION

The present invention relates to a door locking device for household appliances, in particular to a control circuit for operating said door locking device.

So-called locking devices for locking the door of a household appliance, typically a washing machine, which comprise a device for detecting a closing condition of a household appliance door, a device for locking and possibly unlocking the household appliance door and a device for detecting the locking condition of such a door, are known and commonly used in the field of household appliances.

The device for detecting the closing condition determines whether the household appliance door is closed.

The closing condition of the door causes the closing of a switch, so that the electronics of the machine can detect that the door is actually in the closing position.

The closing condition of the door is a precondition for the door to be locked.

The locking device of the household appliance door can be actuated in order to lock the closed door if the door is in the closing condition, and thus take it to a condition in which the door cannot be opened.

The fact that the door is locked in addition to being closed is detected by the detecting device of the locking condition.

The detecting device of the door closing condition thus provides a signal, which confirms that the door is closed. This signal transmits the fact that the door is closed and can thus be locked to a door locking control.

In turn, the detecting device of the door locking condition provides a signal, which confirms that the door is locked. This signal transmits the fact that the door can no longer be opened to the control electronics and that the household appliance can be actuated as a consequence.

PRIOR ART

To date, the arrangement of a control which checks the closing condition of the door and allows to lock it, also detecting the locking condition of the door in order to prevent an actuation of the household appliance until such a locking condition of the door is detected, is the minimum requirement asked by household appliance safety standards.

Various solutions have thus been developed over the years to make devices which allow the mentioned dual function: to check closing with consequent possibility of actuating the lock and to check the correct locking condition.

As a representative example of the prior art reference is made to prior patent EP1834027, which describes a device based on a three-wire circuit as innovative.

According to EP1834027, the invention it describes relates to a door locking device which comprises the function of checking the closing of the door and of locking it as mentioned above, and is based on a circuit which comprises only three connecting contacts, according to the diagram shown in appended FIG. 1, which reproduces FIG. 8 of patent EP1834027.

The same prior patent illustrates that the prior art, shown for example in FIG. 4, reproduced in FIG. 2 here, comprises examples of devices adapted to perform the same technical function described for the door lock which use no fewer than six connecting contacts to the control circuit of the household appliance.

The prior art shown in FIG. 3 (corresponding to FIG. 9 of patent EP1834027) relates instead to a known door locking device of the simpler type which thermoelectric actuators have three connecting contacts I, II and III, as shown in FIG. 3. Unlike the ones considered here, these door locks do not have any device for determining whether the household appliance door is closed or not. FIG. 3 diagrammatically shows an electric diagram for locking a door of known type with thermoelectric actuator, indicated as TA, in form of an actuator element indicated as FTC, and a device indicated as DV to detect a locking condition.

In order to obtain the locking of the door with electromagnetic actuator or thermomagnetic actuator, it was necessary to provide numerous connection devices on household appliance side, in particular three-contact connections on one side and six-contact connections on the other side, with this type of circuit. The three-contact connection shown in FIG. 3 alone not being suitable to check the door closing condition and the door locking, condition at the same time.

The technical solution which is the object of patent EP1834027, based on the circuit shown in FIG. 1 here, thus belongs to this prior art.

Such a solution includes the presence of a door contact switch 10, a locking contact switch 46 and an actuator 24, as electric switching diagram.

The door contact switch 10 and the actuator 24 are electric-ally connected in series between the connecting contact 20 and the second connecting contact 34.

In parallel to this switching in series, the locking contact switch 46 is connected between the first connecting contact 20 and the third connecting contact 56.

The door contact switch 10 is open until the door of the household appliance is closed.

Activation of the actuator 24 by supplying electric power through the first and the second connecting contacts 20 and 34 is therefore not possible.

The door contact switch 10 is closed if the household appliance door is closed. Thus, the first and the second connections 30 and 32 of the actuator are electrically connected to the first and the second connecting contacts 20 and 34.

In this condition, the actuator 24 may by controlled by supplying energy by means of the first and the second connecting contacts 20 and 34, for example in form of pulse actuation.

The activation of the actuator 24 for locking the household appliance door causes a closing of the locking contact switch 46. This situation is indicated by a dashed line in the diagram in FIG. 1.

The closed locking contact switch 46 produces an electric connection between the first 20 and the third 56 connecting contacts in response to the locking.

An electric connection between the first and the third connecting contacts 20 and 56 confirms that the door is locked and that the household appliance may be started to the control electronics of the household appliance.

The first connecting contact 20 is generally connected to ground.

The second connecting contact 34 is generally connected with an electric connection to a household appliance control in order to be able to supply the control signals (e.g. pulse signals) to the actuator 34.

The first connecting contact 56 is preferably connected to a connection of a household appliance which has a predetermined potential, different from ground. The current passes between the first and the second connecting contacts 20 and 56 if the locking contact switch 46 is closed. This passage of current confirms the locking condition of the household appliance.

SUMMARY OF THE INVENTION

It is the main task of the present invention to provide a control circuit and a door locking device based on said control circuit, which includes a reduced number of connecting contacts to the machine and which allows to associate a specific control mode for changing the locking device state, i.e. for locking or unlocking the device, to each pulse.

Within said task, it is the object of the present invention to provide a configuration of a control circuit for a door locking device of the type adapted to detect the closing condition and the locking condition of a household appliance door, which is characterized in that it has at least one diode on the circuit branch which takes current from the circuit actuator, typically a solenoid.

In particular, it is mentioned that devices with from 6 to 5 contacts came to replace devices with 3 contacts in the sector over the years by virtue of the range of products introduced on the market also by the applicant itself during the 1970s and 1980s.

However, such devices do not allow to implement a specific control mode which determines a specific action.

This purpose and the other objects which will be more apparent following a detailed description of the present invention given here by means of illustrative, non-limitative example, are reached by a control circuit for a locking device of a household appliance door having a first, a second and a third connecting contacts with the household appliance, the device comprising:

- a door locking switch arranged on said first contact;
- a door closing switch arranged on said third contact and electrically in parallel with said locking switch;
- an actuator arranged electrically in series with said door closing switch;
- at least one diode and at least one control switch on said third contact and electrically in series between said actuator.

BRIEF DESCRIPTION OF THE FIGURES

Further features and advantages of the present invention will be more apparent in the following detailed description provided by way of nondimitative example and illustrated in the accompanying figures, in which.

DETAILED DESCRIPTION OF THE INVENTION

Figure 1:
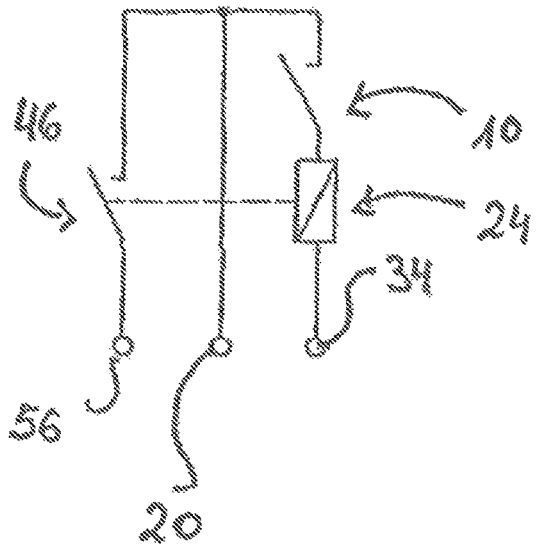
Fig. 1 Prior Art
FIGS. 1 to 3 show examples of door locking circuits of the known type of the prior art.
Figure 2:
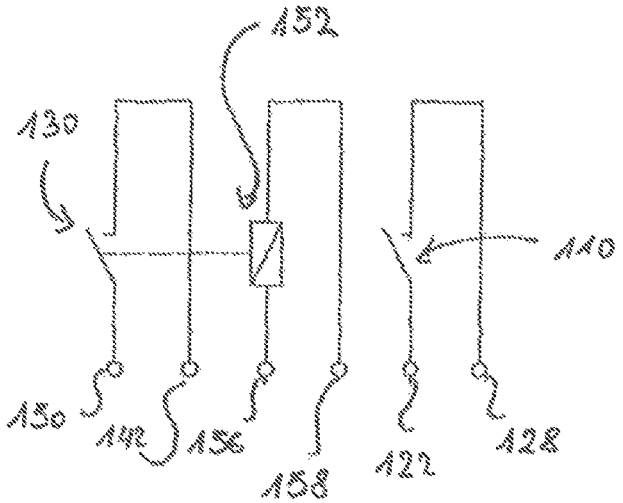
Fig. 2 Prior Art
Figure 3:
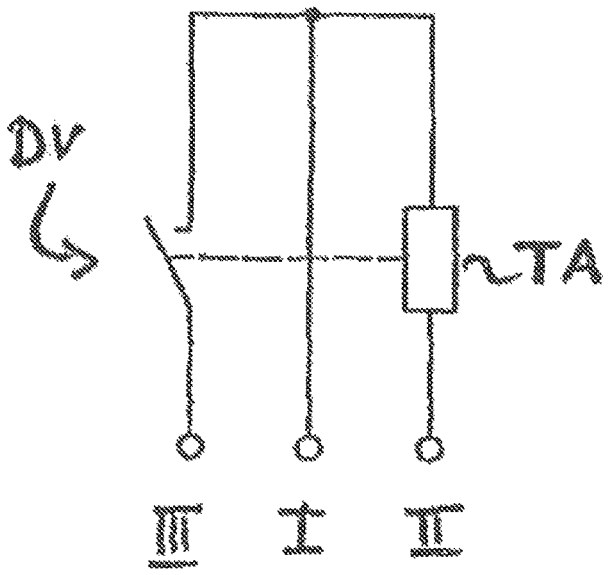
Fig. 3 Prior Art
Figure 4:
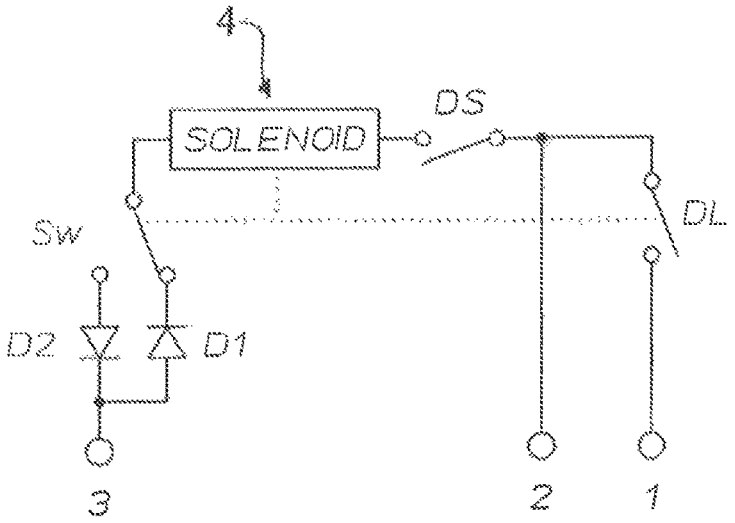
FIG. 4 shows a first embodiment of an electrical circuit diagram of the locking device according to the present invention.

With particular reference to FIG. 4, the device according to the present invention comprises three connecting contacts to the household appliance, in particular a first contact 1, a second contact 2 and a third contact 3.

Following the electric circuit diagram shown in FIG. 4 starting from said first connecting contact indicated by 1, the device comprises a locking switch DL of the door, arranged electrically in series on said connecting contact 1.

The branch connected to the second contact 2 is electrically in series with the first branch connected to said first contact 1.

A third branch connected to said third contact 3 and is connected with said first branch connected to the first connecting contact 1, and an actuator 4 and a door closing switch DS are arranged in series on said second branch.

In the described general diagram, said actuator 4 may preferably consist of a solenoid valve, and in such a case the device will be supplied with alternating current.

The locking device described above operates as follows.

When the door of the household appliance is open, the circuit of the device is in the configuration of FIG. 4, in which both switches, i.e. the door closing switch DS and the door locking switch DL, are open.

In this configuration, the control electronics of the household appliance detects the door opening condition deriving from the opening of the closing switch DS.

When the user manually closes the household appliance door, the closing switch DS is closed and the control electronics thus detects the closing of the circuit between the second 2 and third 3 connecting contact.

In accordance to a first embodiment of the device according to the present invention, at least one control switch SW and at least one diode D are interposed between said third connecting contact 3 of the circuit of the household appliance and said actuator 4.

More in detail, according to the embodiment shown in FIG. 4, a first diode D1 and a second diode D2 are arranged electrically in parallel between said third contact 3 and said actuator 4 together with a control switch SW, which allows to connect said actuator 4 to said third connecting contact 3 in series selectively by means of either said first diode D1 or said second diode D2.

Therefore, the operation of the device thus configured is the following.

In the opening condition of the household appliance door, the closing switch DS on the second branch is open, and the locking switch DL on the first branch is also open, the control switch SW is in contact with the first diode D1, as shown in FIG. 4.

When the door is closed and the closing switch DS closes, the actuator 4 may be supplied with current because the circuit is closed between the second connecting contact 2 and the third connecting contact 3.

At this point, the control electronics of the household appliance sends an electrical locking pulse in input to the third connecting contact 3.

According to a preferred embodiment of the present invention, said first diode D1 allows the passage of an electrical pulse consisting of a positive half wave. Only such pulse can thus activate said actuator 4, because it can cross said first diode D1.

At this point, the actuator 4 can close the locking switch DL and switch the control switch SW on said second diode D2.

In this configuration, both switches DS and DL are thus closed, the control unit detects a door closing and locking condition and the control switch SW closes the branch connected to the third connecting contact 3 on said second diode D2.

Said second diode D2 will be advantageously configured to allow the passage of an electrical unlocking pulse, consisting of a negative half wave in this case.

In this manner, in the condition described above corresponding to a door closing and locking configuration, only a negative half wave pulse may activate the actuator 4 because only such a pulse may cross the circuit branch on which it is positioned, between said third connecting contact 3 and said control switch SW, said second diode D2.

A negative half wave pulse thus operates the actuator 4 which opens the locking switch DL allows the manually opening of the door and the consequent opening of the closing switch DS, said actuator 4 controlling said control switch SW, which is returned to closing on said first diode D1, at the same time.

By virtue of the device according to the present invention illustrated hereto, it is thus possible to control the locking and the unlocking of the locking switch DL, which allows the subsequent opening of the door by the operator, by means of a well-defined electrical pulse chosen during the step of designing, thus overcoming the inherent limit of devices of the known type consisting in that it is not possible to achieve a univocal correspondence between electrical pulse supply to the circuit and the action performed by the actuator 4.

Indeed, with the devices of traditional type, an action of the actuator 4 always corresponds to an electrical pulse arriving to the actuator 4 itself which switches the state of the unlocking switch DL from the current state to the opposite state: it closes it if it was open and opens it if it was closed.

Figure 5:
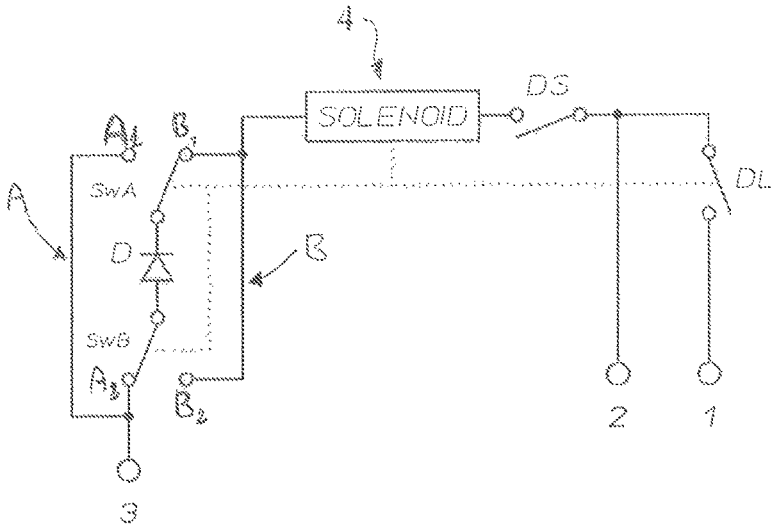
FIG. 5 shows a second embodiment of an electrical circuit diagram of the locking device according to the present invention.

With reference to FIG. 5, a second preferred embodiment of the device according to the present invention will now be illustrated, in which the circuit has, similarly to the case described above with reference to FIG. 4, a first 1, a second 2 and a third 3 connecting contacts of the circuit of the household appliance device, a closing switch DS arranged in series with an actuator 4 on the second connecting branch to said third contact 3, a locking switch DL arranged on the first branch and electrically in parallel to said third branch.

At least one diode D and at least two control switches $SW_A$ and $SW_B$ are preferably arranged between said third connecting contact 3 and said actuator 4.

In the embodiment illustrated in FIG. 5, following the circuit starting from said third connecting contact 3, a first control switch $SW_A$, a diode D, and a second control switch $SW_B$ are arranged in series between said third connecting contact 3 and said actuator 4.

Said third connecting contact 3 is connected to a second pole $A_2$ of a fourth circuit branch A which ends with a first pole $A_1$ of said fourth branch A.

Said second branch of the circuit on which said actuator 4 and said closing switch DS are present is connected with a first pole $B_1$ of the third branch, which a second pole $B_2$ of said third branch is arranged between said first pole $B_1$ and said actuator 4.

With reference to FIG. 5, said first control switch $SW_A$ may be switched between said first pole $A_1$ of said fourth branch A and said first pole $B_1$ of said third branch, while said second control switch $SW_B$ may be switched between said second pole $A_2$ of said fourth branch A and said second pole $B_2$ of said third branch.

Said diode D is arranged in series between said first control switch $SW_A$ and said second control switch $SW_B$.

The operation of the circuit of the device according to the present invention and according to this second preferred embodiment is the following.

When the door of the household appliance is open, the circuit of the device is in the configuration of FIG. 5, in which both switches, i.e. the door closing switch DS and the door locking switch DL, are open.

In this configuration, the control electronics of the household appliance detects the door opening condition deriving from the opening of the closing switch DS.

When the user manually closes the household appliance door, the closing switch DS is closed and the control electronics thus detects the closing of the circuit between the second 2 and third 3 connecting contacts.

Said first control switch $SW_A$ is closed on said first pole $B_1$ of said third branch, and said second control switch $SW_B$ is closed on said second pole $A_2$ of said fourth branch A.

In this manner, the current pulse which reaches the circuit from the third connecting contact 3 passes from said second pole $A_2$ of said fourth branch A, crosses said second control switch $SW_B$, through the diode D and reaches the actuator 4 through the first pole $B_1$ of said third branch.

By virtue of this configuration, the circuit may be supplied with a positive half wave looking pulse; indeed, only such a pulse can activate the actuator 4, because it is the only pulse which can cross the diode D.

According to a possible alternative embodiment, obviously said diode D could be configured in a manner so as to allow the passage of a negative half valve electrical pulse.

When the actuator 4 is supplied by the current, it operates, as occurs in the embodiment shown in FIG. 4, both the locking switch DL and the first $SW_A$ and the second $SW_B$ control switches.

In particular, said actuator causes the closing of the locking switch DL and switches the first control switch $SW_A$ on said first pole $A_1$ of said fourth branch A and said second control switch $SW_B$ on said second pole $B_2$ of said third branch.

In this configuration, both switches DS and DL are closed, the control electronics of the household appliance detects a door closing and locking condition and the control switches $SW_A$ and $SW_B$ close the electrical connection between said third connecting contact 3 and said third branch allowing the passage of an unlocking pulse, in particular in the supplied example this is a negative half wave pulse which in the provided example, can reach and operate said actuator 4.

A negative half wave pulse thus operates the actuator 4 which opens the locking switch DL allows the manual opening of the door and the consequent opening of the closing switch DS, said actuator 4 controlling said control switch SW which is returned to closing on said first diode D1 at the same time.

We have thus demonstrated that by virtue of the device according to the present invention illustrated hereto it is possible to control the locking and the unlocking of the locking switch DL which allows the subsequent opening of the door by the operator, by means of an electrical pulse of known, predetermined nature, thus overcoming the inherent limit of devices of the known type consisting in that it is not possible to achieve a univocal correspondence between electrical pulse supplied to the circuit and the action performed by the actuator.

The invention claimed is:

1. A control circuit for a locking device of a household appliance having a first branch connected to a first connecting contact (1), a second branch connected to a second connecting contact (2) and a third branch connected to a third connecting contact (3) of the household appliance, the device comprising:

a door locking switch (DL) arranged on said first branch connected to said first contact (1);

a door closing switch (DS) arranged on said second branch connected to said third contact (3) and electrically in series with said locking switch (DL);

an actuator (4), arranged electrically in series with said door closing switch (DS);

at least one diode (D, D1, D2) and at least one control switch (SW, $SW_A$, $SW_B$) arranged electrically in series between said third contact (3) and said actuator (4);

wherein the at least one control switch ($SW_A$), the at least one diode (D), and a further switch ($SW_B$) are arranged electrically in series between said third connection contact (3) and said actuator (4).

2. A circuit according to claim 1, characterized in that it comprises a fourth circuit branch (A) which comprises a first pole ($A_1$) and a second pole ($A_2$), said second pole ($A_2$) being connected to said third connecting contact (3), and in that said third circuit branch comprises a first pole ($B_1$) of said third branch and a second pole (B2) of said third branch, arranged between said first pole (B1) and said actuator (4).

3. A circuit according to claim 1, characterized in that said actuator (4) is formed by a solenoid.

4. A control circuit for a locking device of a household appliance having a first branch connected to a first connecting contact (1), a second branch connected to a second connecting contact (2) and a third branch connected to a third connecting contact (3) of the household appliance, the device comprising:

a door locking switch (DL) arranged on said first branch connected to said first contact (1);

a door closing switch (DS) arranged on said second branch connected to said third contact (3) and electrically in series with said locking switch (DL);

an actuator (4), arranged electrically in series with said door closing switch (DS);

first and second diodes (D1, D2); and at least one control switch (SW) arranged electrically between said third contact (3) and said actuator (4);

wherein said first diode (D1) and said second diode (D2) being electrically in parallel with each other and arranged between said third contact (3) and said control switch (SW), said control switch (SW) being selectively switchable between said first diode (D1) and said second diode (D2), thus realizing an electrical contact in series between said third contact (3) and said actuator (4).

5. A circuit according to claim 4, characterized in that said actuator (4) is formed by solenoid.

* * * * *